US012729476B2

(12) United States Patent
Bringewatt et al.

(10) Patent No.: US 12,729,476 B2
(45) Date of Patent: Sep. 8, 2026

(54) METHOD AND DEVICE FOR THE WET TREATMENT, IN PARTICULAR THE WASHING AND/OR SPINNING, OF LAUNDRY BATCHES CONSISTING OF A PLURALITY OF LAUNDRY ITEMS

(71) Applicant: HERBERT KANNEGIESSER GMBH, Vlotho (DE)

(72) Inventors: Wilhelm Bringewatt, Lübbecke (DE); Engelbert Heinz, Vlotho (DE)

(73) Assignee: HERBERT KANNEGIESSER GMBH, Vlotho (DE)

( * ) Notice: Subject to any disclaimer, the term of this patent is extended or adjusted under 35 U.S.C. 154(b) by 66 days.

(21) Appl. No.: 18/591,998

(22) Filed: Feb. 29, 2024

(65) Prior Publication Data

US 2024/0295059 A1 Sep. 5, 2024

(30) Foreign Application Priority Data

Mar. 1, 2023 (DE) ..... 10 2023 105 091.5
Apr. 27, 2023 (DE) ..... 10 2023 110 867.0

(51) Int. Cl.
*D06F 34/18* (2020.01)
*D06F 23/02* (2006.01)
(Continued)

(52) U.S. Cl.
CPC ..... *D06F 34/18* (2020.02); *D06F 23/02* (2013.01); *D06F 23/04* (2013.01); *D06F 23/06* (2013.01); *D06F 33/34* (2020.02); *D06F 33/36* (2020.02); *D06F 33/40* (2020.02); *D06F 37/04* (2013.01); *D06F 37/12* (2013.01); *D06F 37/26* (2013.01); *D06F 39/088* (2013.01);
(Continued)

(58) Field of Classification Search
CPC ..... D06F 23/02; D06F 23/04; D06F 23/06; D06F 34/18; D06F 33/34; D06F 33/36; D06F 33/40; D06F 37/04; D06F 37/12; D06F 37/26; D06F 39/088; D06F 2103/02; D06F 2103/04; D06F 2105/48
See application file for complete search history.

(56) References Cited

U.S. PATENT DOCUMENTS 3,945,921 A 3/1976 Toth
8,993,902 B2 * 3/2015 Bringewatt ..... D06F 31/005 177/1
2007/0051011 A1 * 3/2007 Bringewatt ..... D06F 34/18 34/500

FOREIGN PATENT DOCUMENTS

CH 462766 A 9/1968
DE 4219536 A1 12/1993
(Continued)

*Primary Examiner* — Joseph L. Perrin
(74) *Attorney, Agent, or Firm* — Oliff PLC

(57) ABSTRACT

A method and device for the wet treatment of laundry batches provides to load the drum in a plurality of steps. To this end, the laundry batch is divided into partial batches which are gradually loaded into the drum. In particular, the drum is driven in rotation between successive partial batches at a rotational speed which corresponds to the spinning speed and/or supplies liquid to the partial batches during loading. As a result, the individual partial batches are compacted. Due to this compaction, space is provided for the next partial batch. As a result, the drum can be loaded with larger laundry batches of greater weight. This results in a more cost-efficient wet treatment.

5 Claims, 7 Drawing Sheets

Figure 1:
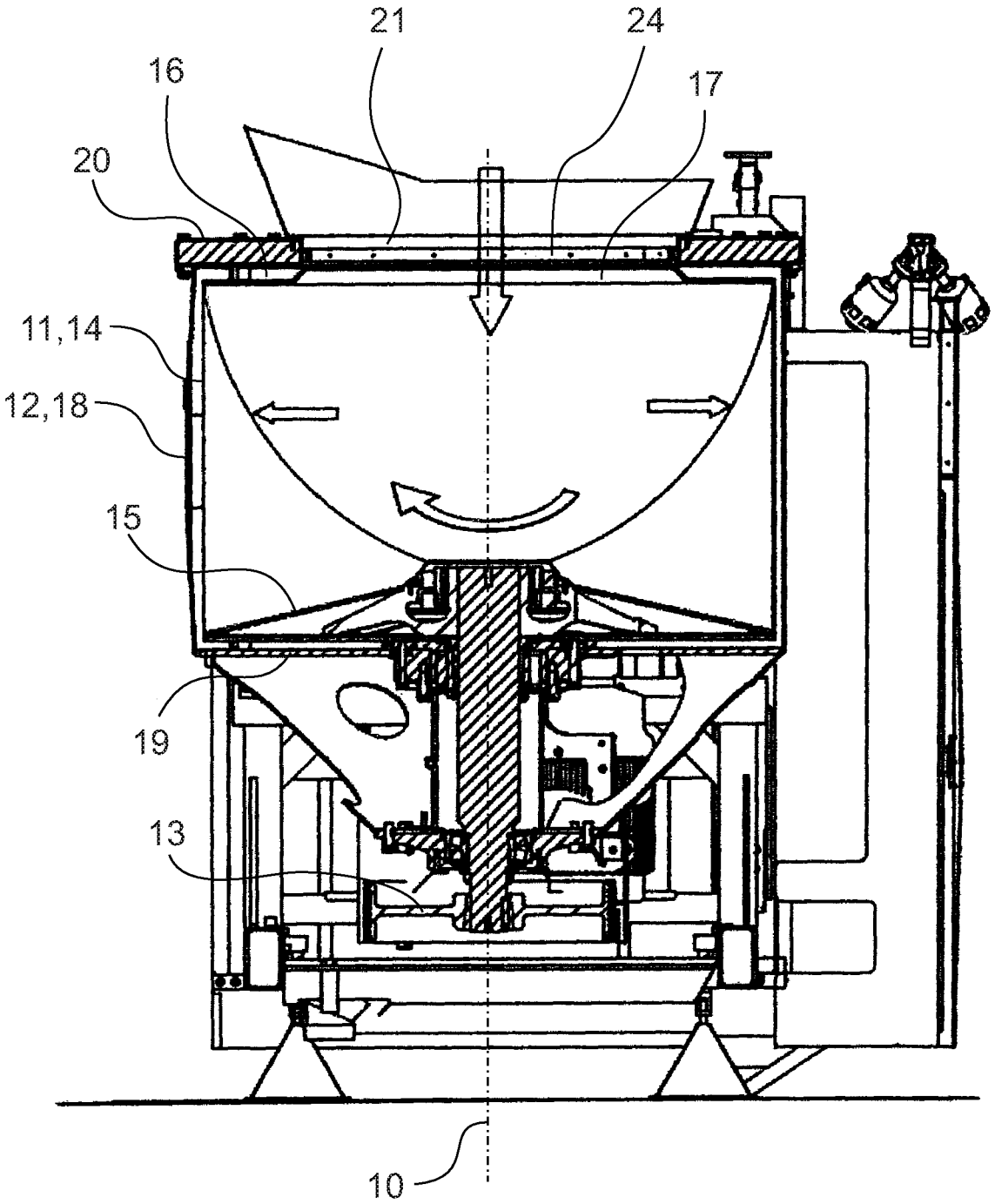

(51) Int. Cl.

| | |
|---|---|
| ***D06F 23/04*** | (2006.01) |
| ***D06F 23/06*** | (2006.01) |
| ***D06F 33/34*** | (2020.01) |
| ***D06F 33/36*** | (2020.01) |
| ***D06F 33/40*** | (2020.01) |
| ***D06F 37/04*** | (2006.01) |
| ***D06F 37/12*** | (2006.01) |
| ***D06F 37/26*** | (2006.01) |
| ***D06F 39/08*** | (2006.01) |
| *D06F 103/02* | (2020.01) |
| *D06F 103/04* | (2020.01) |
| *D06F 105/48* | (2020.01) |

(52) U.S. Cl.
CPC ..... *D06F 2103/02* (2020.02); *D06F 2103/04* (2020.02); *D06F 2105/48* (2020.02)

(56) References Cited

FOREIGN PATENT DOCUMENTS

| | | | | | |
|---|---|---|---|---|---|
| DE | 10227501 | A1 | | 1/2004 | |
| DE | 102009059161 | A1 | | 6/2011 | |
| DE | 102010020073 | A1 | | 11/2011 | |
| DE | 102016004207 | A1 | | 9/2017 | |
| EP | 2405053 | A1 | | 1/2012 | |
| GB | 1111756 | A | * | 5/1968 | ..... D06F 95/00 |

* cited by examiner

METHOD AND DEVICE FOR THE WET TREATMENT, IN PARTICULAR THE WASHING AND/OR SPINNING, OF LAUNDRY BATCHES CONSISTING OF A PLURALITY OF LAUNDRY ITEMS

The invention relates to a method for the wet treatment, in particular the washing and/or spinning, of laundry batches consisting of a plurality of laundry items. The invention further relates to a device for the wet treatment, in particular the washing and/or spinning, of laundry batches consisting of a plurality of laundry items.

The wet treatment of laundry is carried out, in particular, in commercial laundries in batches. In each case, a laundry batch consisting of a plurality of laundry items is wet-treated in a drum which can be driven in rotation. The wet treatment is carried out in laundry machines which serve only for washing or for washing and then spinning. Preferably, these machines are washing machines or washer-extractors which wash and optionally then spin the respective laundry batch in the drum, whereby the laundry batch is partially separated, in particular to a large extent, from the liquid absorbed in the laundry.

In the known methods for the wet treatment of laundry items in batches, the drum of the washing machine or even the washer-extractor is loaded at the same time with all of the laundry items of the laundry batch. All of the laundry items of the laundry batch then pass into the drum as relatively loose bulk material. This limits the number of laundry items per laundry batch and/or the quantity of laundry per laundry batch. This impairs the cost-efficiency of the wet treatment.

The object of the invention is to provide a method and a device for the cost-efficient wet treatment of laundry, in particular the washing and/or spinning of laundry in batches.

One method for achieving the object comprises the measures of carrying out the loading of the drum with the respective laundry batch in partial batches. This results in the loading being carried out gradually in a stepwise manner, step-by-step and/or in a phased manner with successive partial batches. According to requirements, the respective laundry batch can be divided into two, or more than two, partial batches, wherein all of the partial batches together make up a quantity of laundry which corresponds to the desired laundry batch. All of the laundry items of the respective laundry batch are washed and/or spun at the same time in the drum. As a result, the partial batch loaded last can "settle", preferably reduce its volume, before the next partial batch is loaded.

It is also provided to reduce the volume of the laundry items of the respective partial batch, at least between successive partial batches, optionally also after the last partial batch, preferably by the drum being driven in rotation. This can occur between the loading of the drum with successive partial batches, but also alternatively or additionally when loading the drum with the respective partial batch. By driving the drum in rotation, a centrifugal force is exerted on the laundry items of the respective partial batch, which leads to the laundry items, above all the laundry item loaded last into the drum, being distributed in an annular manner on the inner face of the circumference of the drum. Preferably, by driving the drum in rotation, the laundry items forming the ring of laundry are preferably also pressed together, compressed and/or compacted. As a result, the volume of the partial batch which is already located in the drum or the partial batch, which is already located in the drum, of the partial batch loaded last into the drum and/or all of the partial batches which are already located in the drum, is reduced and thus space is provided for loading the drum with a further partial batch. Preferably, a sufficiently large free space is provided in the center of the drum for the next laundry batch.

The method according to the invention makes it possible to load the drum with larger laundry batches, in particular laundry batches having a greater number of laundry items and/or a greater quantity of laundry in comparison with the previously usual loading.

Preferably, the method is configured such that the loading of the drum with the respective partial batch is carried out when the axis of rotation of the drum is upright, preferably perpendicular or substantially perpendicular. During this loading, the opening of the drum is located at the top, preferably at the highest point of the drum.

It is conceivable that the loading of the drum with the respective partial batch is carried out when the drum is driven in rotation. As a result, already during the loading, the laundry items of the respective partial batch are pressed together at least at the start, in particular pressed against the inner face of the lateral surface of the drum and/or distributed thereon in order to form a ring of laundry.

If, when loaded with the respective partial batch, the drum is driven about its axis of rotation, preferably the perpendicular axis of rotation, the rotational speed can be such that a centrifugal force of between 2 and 6 times the gravitational acceleration (g) is exerted on the laundry items. No spinning effect or only a small spinning effect is exerted on the laundry items of the partial batch in the drum or the partial batches in the drum.

An advantageous possibility for developing the method is provided by driving the drum in rotation after at least one phase or a step of the loading thereof with one respective partial batch, in particular the loading with the next partial batch, in the manner of a spinning process, preferably at a higher rotational speed relative to the loading. A compression of the at least one partial batch which is already located in the drum takes place at the same time. Above all, the partial batch loaded last into the drum is compressed and/or pressed together. The phase or the step of driving the drum after the respective loading of a partial batch, in particular between successive loadings of partial batches, in the manner of spinning is denoted hereinafter as the "compacting phase" and the loading of the drum with at least one partial batch is called the "partial loading phase".

Preferably, it is provided that in the compacting phase the drum is driven at a rotational speed in which a centrifugal force, which is between 25 and 70 times the gravitational acceleration (g), is exerted on the laundry items already located in the drum. Such a rotational speed of the drum which is significantly higher than the rotational speed of the drum, which is optionally driven in rotation in the partial loading phase, leads to a reliable formation of a ring of laundry on the inner face of the preferably cylindrical lateral surface of the drum and at the same time a significant pressing together, compression and/or compacting of the laundry items of the ring of laundry.

According to a further embodiment of the method, after loading with one respective partial batch, it is provided to pivot the drum from its loading position in which its axis of rotation runs upright, in particular perpendicularly, into a position in which the axis of rotation runs obliquely to the perpendicular, preferably at an angle of 30° to 50°. In the pivoted, obliquely oriented position the drum is then driven in rotation in the compacting phase, preferably at a significantly higher rotational speed than in the partial loading phase. The oblique position of the axis of rotation of the drum leads, at least at the start, to a release of the laundry items in the upper reversal region of the drum and to the released laundry items dropping down onto a lower region of the drum. This leads to a uniform and improved annular distribution of the laundry items on the circumference of the drum.

At least in the compacting phase and/or partial loading phase, preferably only the compacting phase, it is preferred if liquid is supplied to the drum, preferably through the opening of the drum. As a result, the laundry items are immersed in the drum. The laundry items are wetted, or wetted further, by the supplied liquid. In particular with an oblique position or inclined position of the drum, in the compacting phase liquid not yet absorbed by the laundry items collects at the lowest point of the oblique drum into which the laundry items which are not yet distributed around the circumference of the drum are immersed and/or drop and as a result they absorb moisture and become heavier. The force at which the laundry items are pushed against the inner face of the lateral surface of the drum when the drum is driven in rotation in the compacting phase is increased thereby.

Finally, it is conceivable to develop the method such that at least when the drum is driven in rotation, the behavior of the laundry items in the drum is monitored between successive phases of the loading with partial batches, namely the compacting phase. Preferably, this monitoring is carried out as to whether the partial batch loaded last into the drum has already adopted an annular shape which is distributed on the inner face of the lateral surface. Alternatively or additionally, it is possible to determine the thickness of the ring of laundry of all of the partial batches previously loaded into the drum and/or the increase in the thickness of the ring of laundry as a result of the partial batch loaded last into the drum. This can be optically carried out by ultrasound or even by markings on the base of the drum. In particular, it can be established thereby how far the ring of laundry has been formed and the laundry has been compressed, and accordingly influence and/or control the time for driving the drum more rapidly in rotation in the compacting phase. Alternatively or additionally, it is also possible to compare the results of this monitoring with reference values and, when deviating from the reference value, to infer the respective compacting phase.

A device for achieving the object mentioned in the introduction is a device that it is provided to assign liquid outlet openings generating liquid jets, which are arranged in an annular manner, to an opening of the housing or the drum. A type of "immersion ring" is provided thereby on the opening of the housing of the drum and/or the drum itself.

The liquid jets generated in an umbrella-like manner by the immersion ring are distributed about the edge of the opening of the drum and/or the housing thereof and oriented through the opening of the drum into the interior thereof. Preferably, in this manner when loading the drum the laundry can be effectively immersed in the drum and/or the laundry wetted or the already wetted laundry made even more wet. Preferably, such a device is suitable for carrying out the method according to the invention.

Preferably, it is provided to arrange the liquid outlet openings, which are arranged in an annular manner, in a wall of an annular pipe and to arrange this annular pipe on the inner face on the circumference of the opening of the housing. This opening of the housing corresponds to the opening of the drums which can be driven in rotation for receiving the laundry. The liquid outlet openings of the annular pipe can generate liquid jets which are oriented through the opening of the drum into the interior thereof.

One advantageous possible development of the device provides to arrange the liquid outlet openings of the annular pipe to be uniformly distributed in a wall thereof, such that all of the liquid jets exiting from the liquid openings can pass through the opening into the drum and/or converge in an umbrella-like manner in the direction of a wall opposing the opening in the drum, in particular the bottom wall thereof.

Preferably, it is provided to configure all of the liquid outlet openings of the annular pipe and to assign them to the annular pipe such that all of the liquid jets are brought together before a lowest point of the drum. This leads to an effective wetting of the laundry items when loading the drum and/or of the laundry items already located in the drum.

The device can have at least one protective body, preferably a circumferential protective ring, between the annular pipe in the opening of the housing and the drum, preferably an edge surrounding the opening of the drum. This protective ring prevents, on the one hand, primarily small laundry items from being caught between the drum and the fixed housing surrounding the drum on the outer face. On the other hand, primarily when the drum is being driven rapidly in rotation, the protective body serves for protection against the possible contact of the edge of the opening with the annular pipe assigned to the opening of the housing and the edge of the opening of the drum. To this end, it can preferably be provided to form the protective body from a non-metallic material, for example plastics, primarily slidable plastics.

It is also conceivable to develop the device such that it has means which are configured to determine the degree of compaction and/or the weight of the laundry already located in the drum. Alternatively or additionally, it is also conceivable that these means are configured to determine the thickness of the respective ring of laundry located in the drum. The above-mentioned measuring and/or detection methods are preferably configured such that they operate contactlessly.

Determining the degree of compaction, for example the thickness of the ring of laundry or the weight thereof, enables it to be established whether in the compacting phase the laundry batch respectively loaded last into the drum has already adopted the desired annular shape and/or is compressed in the intended circumference. Thus a continuous monitoring can be carried out as to whether the loading process runs correctly and sufficient space remains in the drum in order to load further partial batches, in particular a last partial batch for completing the laundry batch respectively to be wet-treated.

Figure 2:
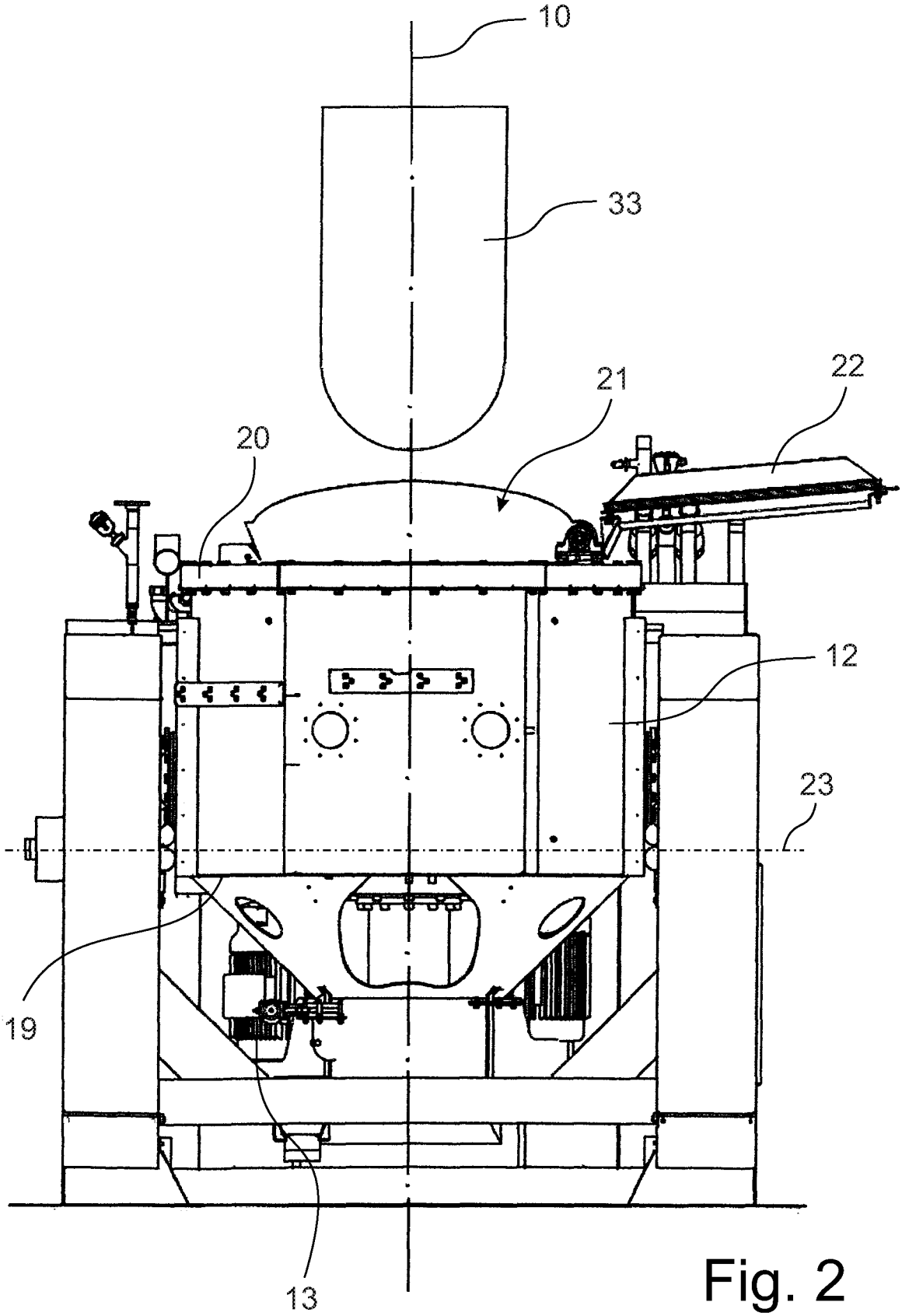
Figure 3:
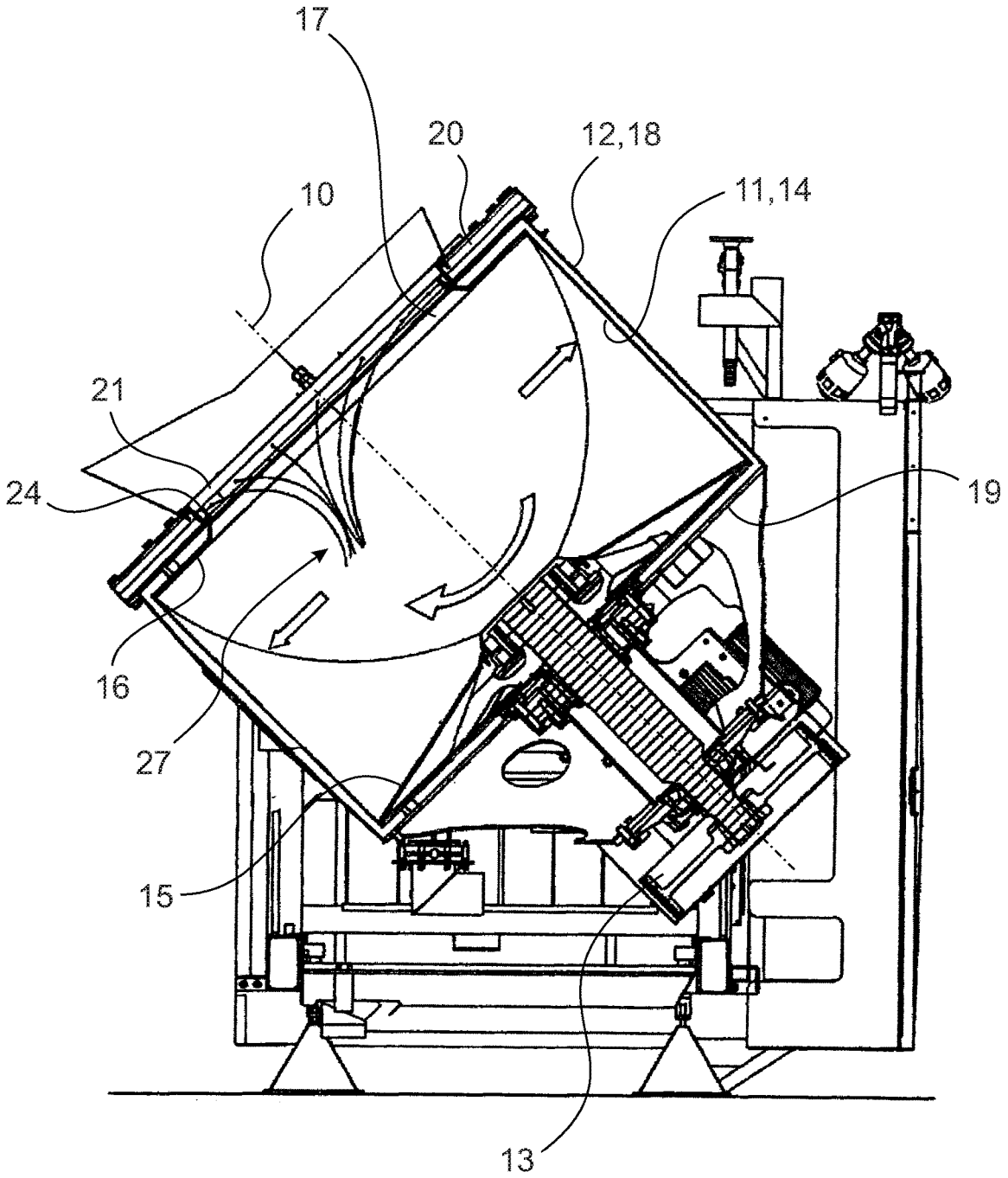
Figure 4:
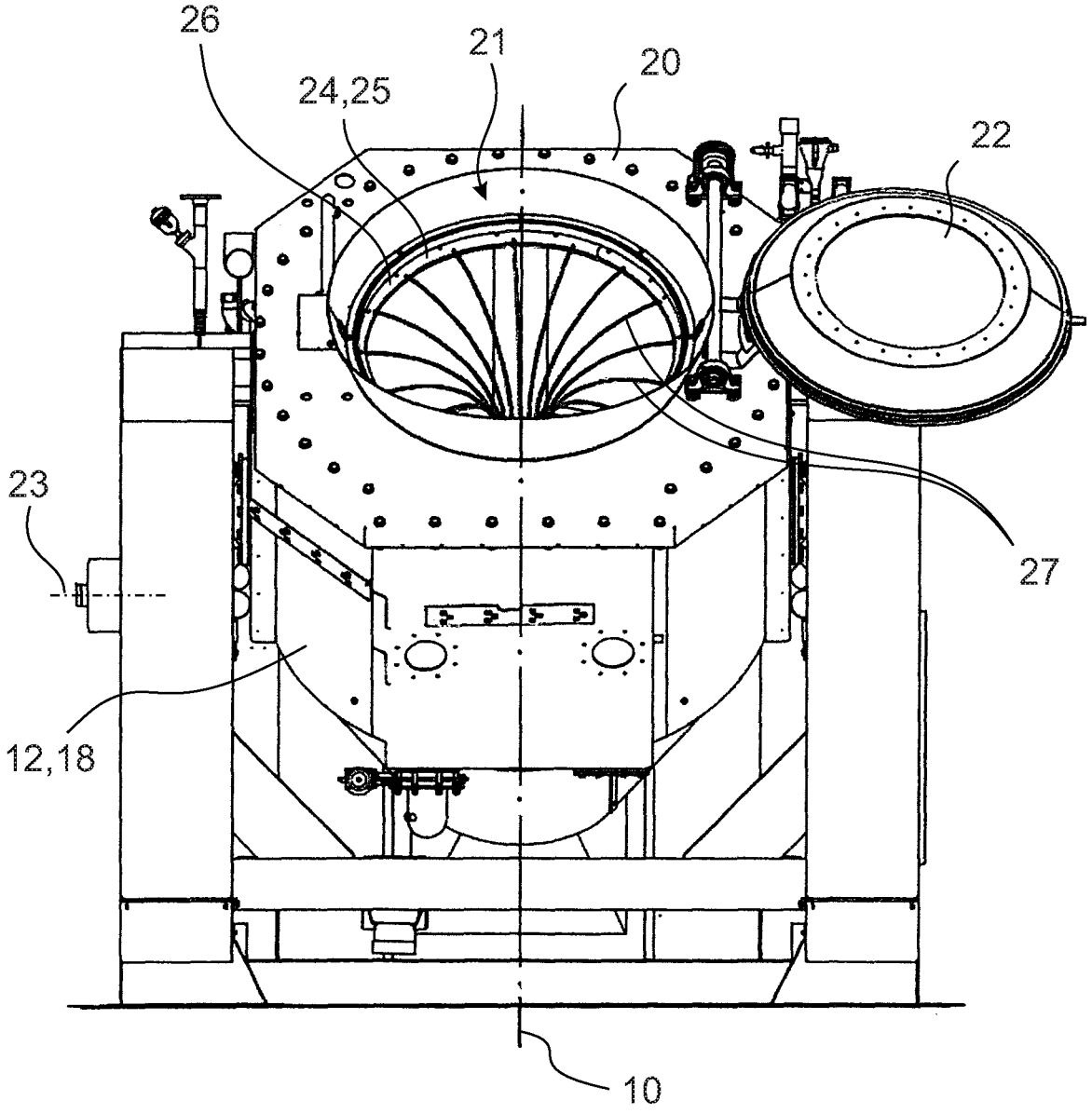
Figure 5:
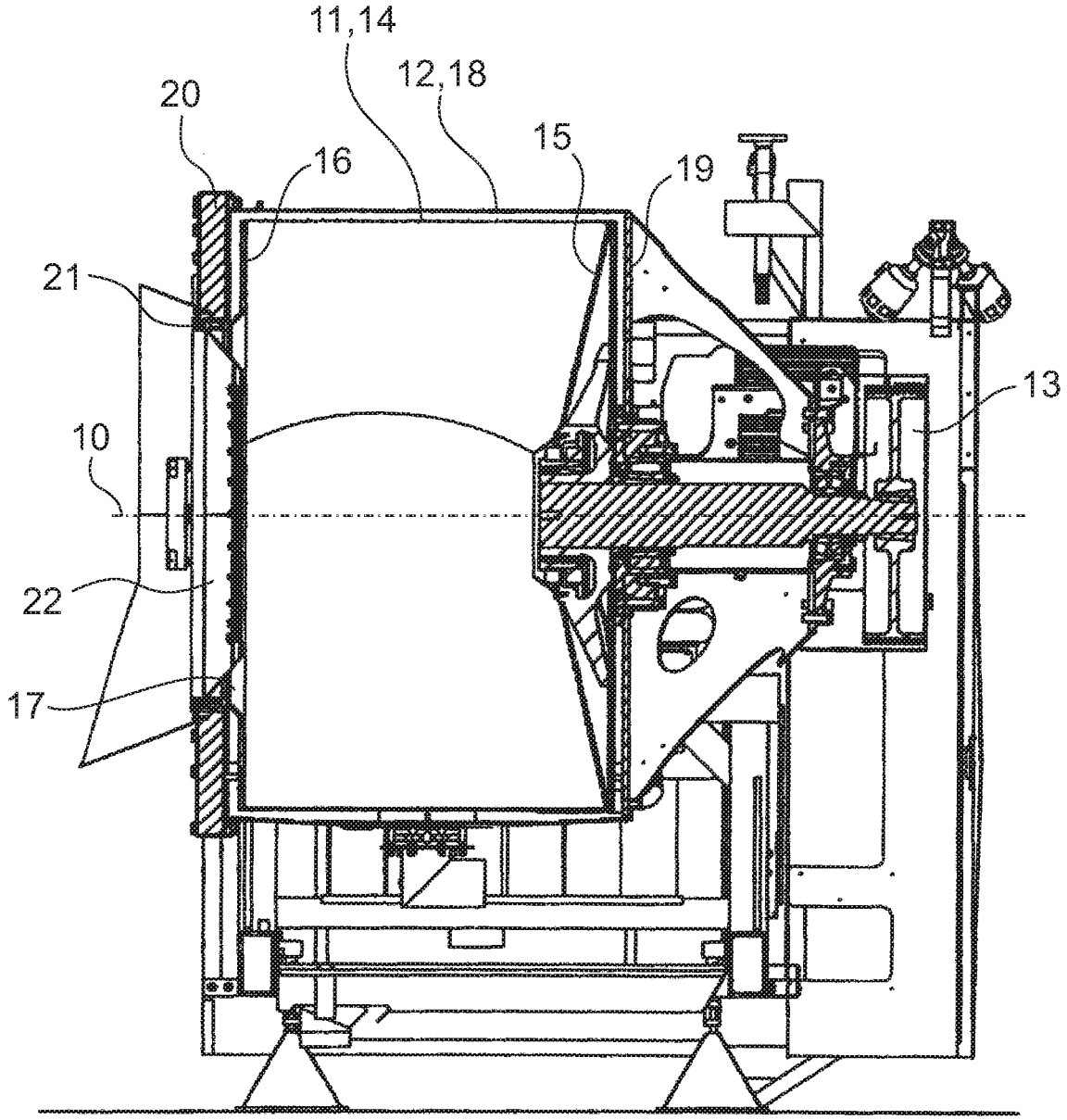
Figure 6:
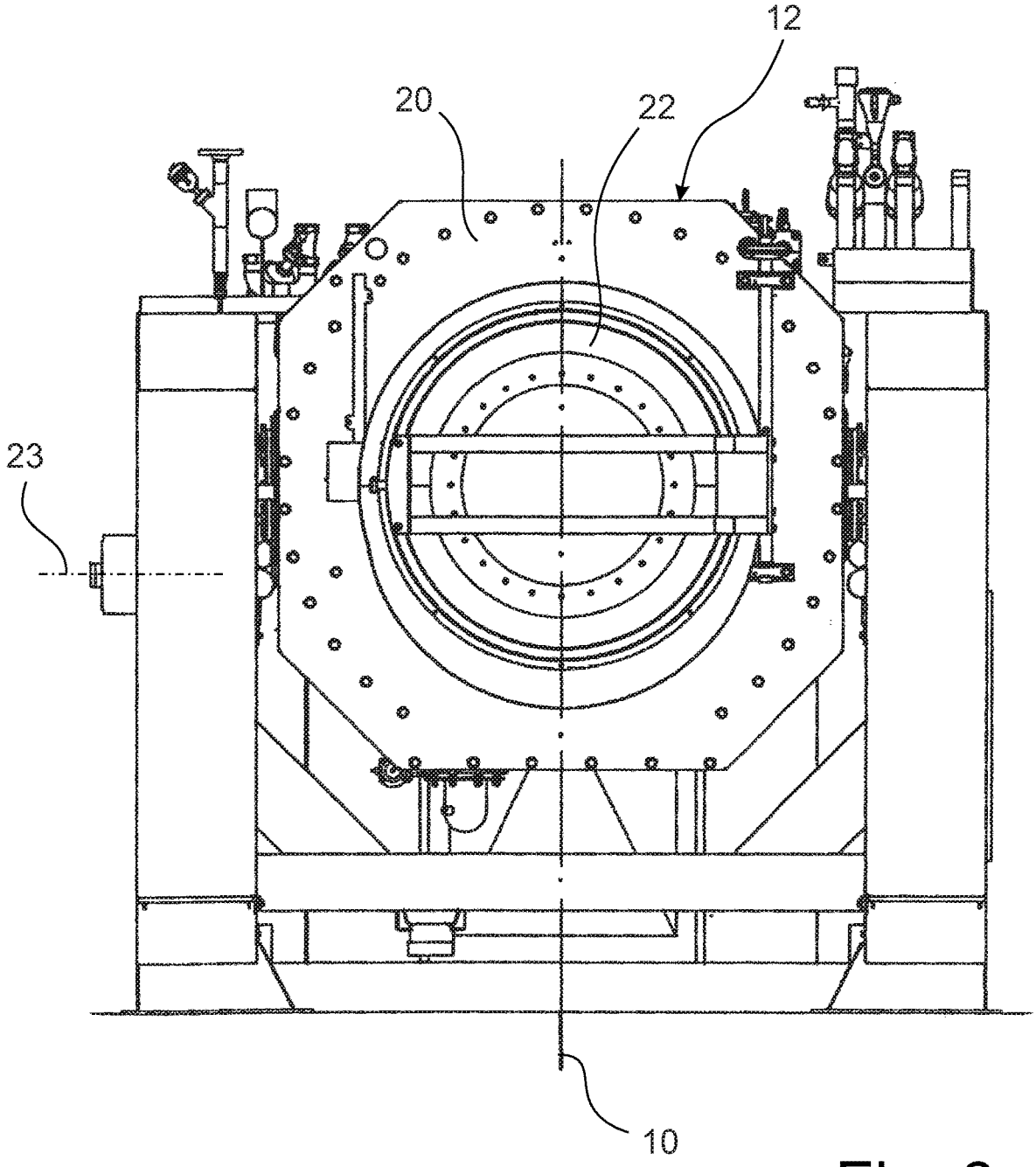
Figure 8:
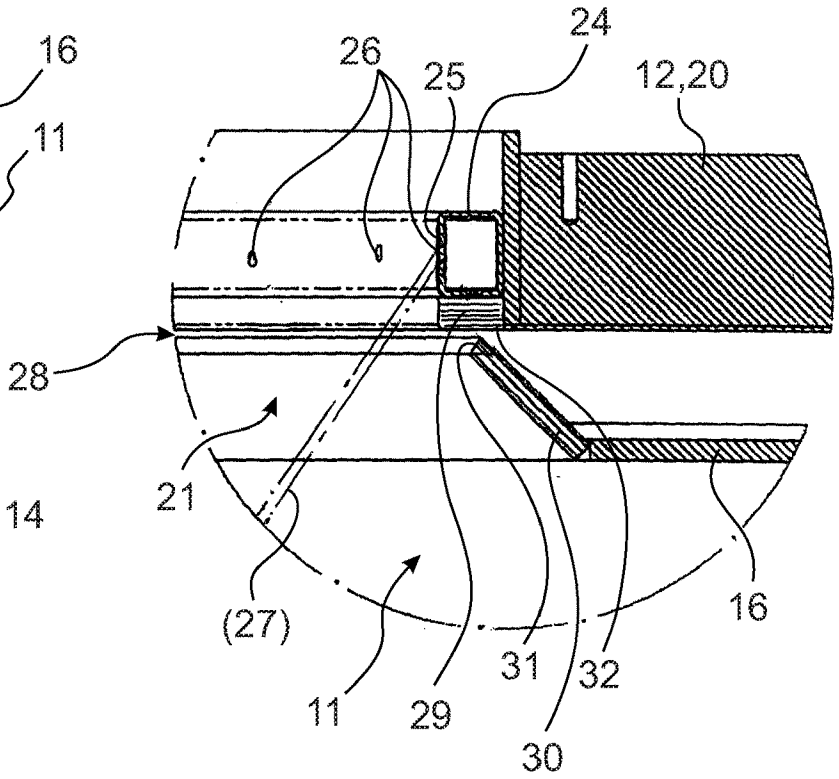
Figure 7:
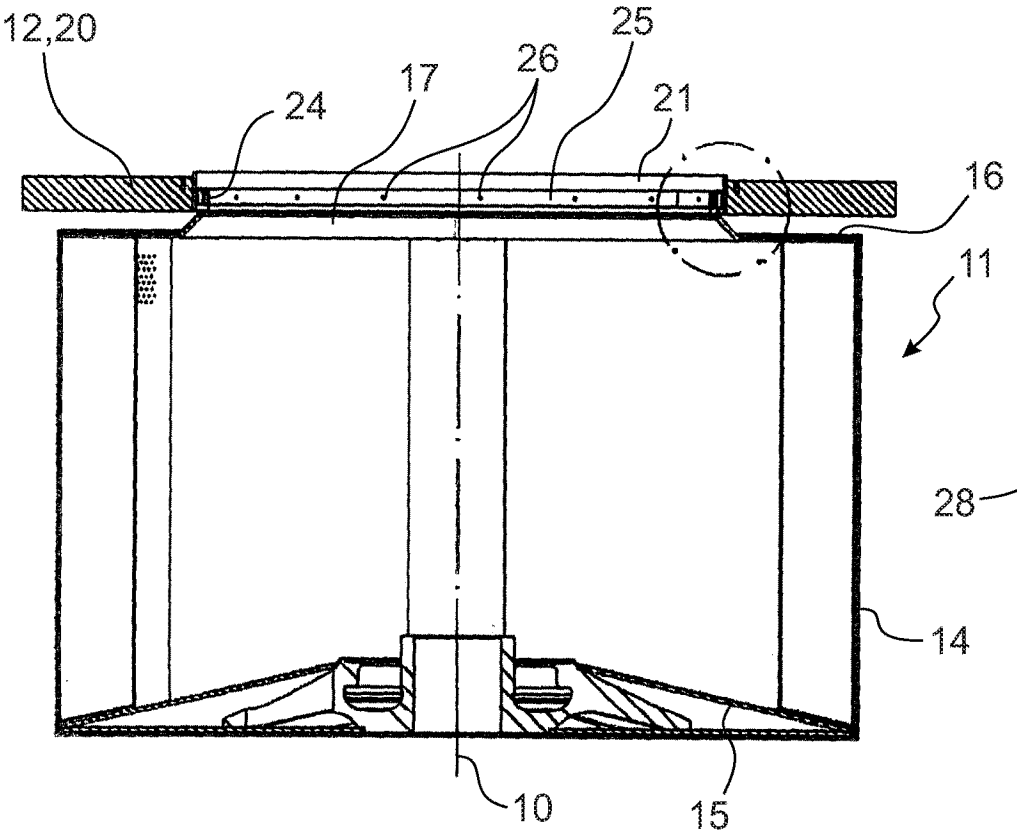

Preferred exemplary embodiments of the invention are described in more detail hereinafter with reference to the drawing, in which:

FIG. 1 shows a partial sectional side view of a device in a partial loading phase, FIG. 2 shows a front view of the device of FIG. 1, FIG. 3 shows a partial sectional side view of the device in a compacting phase, FIG. 4 shows a front view of the device of FIG. 3, FIG. 5 shows a partial sectional side view of the device in an unloading phase, FIG. 6 shows a front view of the device of FIG. 5, FIG. 7 shows a central longitudinal section through a drum and a front wall of a housing of the device assigned thereto according to FIG. 1, and FIG. 8 shows an enlarged detail VIII of the view of FIG. 7.

Laundry items can be wet-treated by washing and subsequent spinning with the device shown in the figures. The invention is also suitable, however, for devices in which the laundry items are wet-treated only by washing. The spinning can then be carried out in a separate device, if required. Devices which permit the washing and the subsequent spinning of laundry items are denoted in specialist language as "washer-extractors". Those devices, which serve only for washing the laundry items, are generally denoted as "washing machines".

The laundry items can be any type of laundry items, for example bed linen and table linen, dry laundry such as terry towels, or shaped items such as for example items of clothing, including workwear.

The laundry items are wet-treated in batches by the device for wet treatment, namely washed and spun or only washed.

The device shown has a drum 11 which can be driven in rotation about an axis of rotation 10, a fixed housing 12 surrounding at least the drum 11, and a partially shown drive 13 for driving the drum 11 in rotation about its axis of rotation 10.

The drum 11 has an entirely or substantially cylindrical drum lateral surface 14, a bottom wall 15 and a circular front wall 16. The circular front wall 16 surrounds the preferably circular opening 17 of the drum 11. The drum 11 is provided with connections, not shown, for the supply of liquid serving for the wet treatment for changing the bath and for removing absorbed washing liquor removed from the laundry items during spinning.

The drum 11 is surrounded by the fixed housing 12 in a fluid-tight manner. The housing 12 is dimensioned such that the drum 11 can freely rotate therein. The housing 12 can also be configured to be cylindrical—as is the drum 11—but also cuboidal in contrast to the drum 11. The housing 12 is fixedly assigned to the drum 11 such that, in the case of a drum 11 which can be driven in rotation, it does not rotate with the drum 11. The housing 12 has a lateral surface 18 surrounding the drum 11, a bottom wall 19 and a front wall 20. The front wall 20 is configured in a circular manner since it surrounds an opening 21 of the housing 12. The opening 21 is configured corresponding to the opening 17 of the drum 11, wherein the diameter of the opening 21 can be slighter greater than the diameter of the opening 17 (FIG. 8). The opening 21 of the housing 12 is located immediately adjacent to the front of the opening 17 of the drum 11. One of the openings 17 or 21, preferably the opening 21 of the housing 12, is closeable by, for example, a pivotable cover 22 (FIGS. 2 and 4).

The drum 11 and the housing 12 are pivotable together about a horizontal pivot axis 23 which intersects the axis of rotation 10 at right-angles. FIGS. 1 and 2 show the drum 11 with the housing 12 in a loading position of the device. The axis of rotation 10 runs perpendicularly and the openings 17 and 21 located at the top, when the cover 22 is folded open, are located in a horizontal plane. FIGS. 3 and 4 show the device in an immersion position in which preferably the compacting phase is also carried out, and namely at least to a large part. In this position and/or phase, the drum 11 is pivoted with the housing 12 to the side about the pivot axis 23 relative to the loading position by 30° to 50°. Accordingly the axis of rotation 10 runs so as to be inclined by 30° to 50° relative to the vertical. When the cover 22 is still open the openings 17 and 21 are also inclined, so that they are located in a plane pivoted by 30° to 50° relative to the horizontal.

FIGS. 5 and 6 show the unloading position of the drum 11 and the housing 12. In this unloading position, the axis of rotation 10 of the drum 11 runs horizontally. The axis of rotation 10 can, however, also run slightly downwardly inclined relative to the horizontal in the direction of the openings 17 and 21. In the device shown here, in the unloading position shown in FIGS. 5 and 6, the washing and spinning of the laundry is carried out with the opening 21 of the housing closed in a fluid-tight manner by the cover 22. Only when the laundry is unloaded is the cover 22 opened again. It is also conceivable to wash and/or to spin the laundry in a different position, preferably the immersion position or with an incline between the immersion position shown in FIG. 3 and the unloading position shown in FIG. 5.

According to FIGS. 7 and 8 an annular pipe 24 is assigned to the opening 21 of the front wall 20 of the housing 12. This pipe has a square cross section in the exemplary embodiment shown. However, it can also have different cross sections, for example a triangular or a round cross section. The annular pipe 24 is assigned to a circumferential surface 25 of the front wall 20 of the housing 12 which defines the opening, in particular is fixedly connected thereto. An internal cylindrical surface of the annular pipe 24 is provided with a plurality of liquid outlet openings 26 distributed uniformly over the circumference thereof. These liquid outlet openings are oriented such that liquid jets 27 can exit therefrom and can flow through the opening 17 in the front wall 16 of the drum 11. A liquid jet 27 is indicated by dashed-dotted lines in FIG. 8. All liquid jets 27 exiting from the liquid outlet openings 26 of the annular pipe 24 are also oriented toward the axis of rotation 10, and namely such that they converge in the direction of the bottom wall 15 (FIGS. 3 and 4). It can be identified from FIG. 3 that in the oblique immersion position the liquid jets 27 run together in the direction of a corner between the bottom wall 15 and the lateral surface 14 and namely with a slight spacing from the aforementioned corner. The liquid jets 27 can be brought together, but can only be reduced in terms of spacing relative to one another, without coming into contact.

It can also be derived from FIG. 8 that a protective body, which is configured in the exemplary embodiment shown as a protective ring 29, is arranged in a gap 28 between the front wall 16 of the drum and the annular pipe 24 surrounding the opening 21 in the front wall 20 of the housing 12. The protective ring 29 is provided in the exemplary embodiment of FIG. 8 with a rectangular cross section. The gap 28 between the annular pipe 24 on the front wall 20 of the housing 17 and the drum 11 which can be driven in rotation is virtually closed by this protective ring 29. This is assisted by a frustoconical ring 30 of the front wall 16 of the drum 11 surrounding the opening 17 of the drum 11, the circular circumferential edge 31 thereof facing furthest toward the protective ring 29 terminating with a small spacing of a few millimeters in front of the circular surface 32 of the protective ring 29 oriented toward this edge 31 (FIG. 8). The protective ring 29 is formed from a non-metallic material. In this case it is a material which wears more easily than steel, in particular stainless steel, from which the drum 11 is formed with the ring 30. Preferably, the protective ring 29 serves as a wear part which primarily protects the edge 31 of the frustoconical ring 30 of the drum 11 from wear.

The method according to the invention is described hereinafter on the basis of the device described above.

The device, namely the washing machine or washer-extractor, serves for the wet treatment of laundry items in batches. In each case, a laundry batch of a plurality of laundry items to be wet-treated in a process in the device is transported to the device in laundry bags 33, for example (FIG. 2).

According to the invention the device, namely the washing machine or washer-extractor, is not loaded immediately with the entire laundry batch, but the loading is carried out gradually in partial batches in a stepwise manner or in a phased manner. There can be two or more than two partial batches. With laundry items, in particular lighter laundry items, which take up a lot of space, the laundry batch is divided, for example, into more than two partial batches which together make up the entire laundry batch, preferably the laundry batch delivered in one laundry bag 33. The individual laundry batches can be of the same size, have the same quantity of laundry and/or have the same weight. However, it is also conceivable to form laundry batches of different size, quantity of laundry and/or laundry weight, wherein preferably the partial batches loaded first into the drum 11 are larger than the last partial batches.

By loading the drum 11 in successive partial batches, which together make up the laundry batch, the laundry items of each partial batch have the opportunity to settle in the drum 11 between the loading of successive partial batches, i.e. to reduce their volume, whereby space or at least more space is provided for the loading with the next partial batch.

Preferably, during the loading of the drum 11, the drum is driven in rotation at a relatively low rotational speed, for example a washing speed which leads to forces and/or an acceleration of 2 g to 6 g, in particular 3 g to 6 g, being exerted on the laundry items in the drum 11. This enables the laundry items of the respective partial batch to settle. In particular, this results in a pressing together, compacting, compression and/or volume reduction of the laundry items of the respective partial batch. For the sake of simplicity, only "compacting" and/or "volume reduction" of the laundry items are referred to hereinafter.

It is conceivable that a pause, in particular a loading pause, in which the drum 11 continues to be driven in rotation, preferably at an unchanged rotational speed, is introduced between the loading of the drum 11 with successive partial batches, wherein this pause can be short, for example only 10 to 30 seconds. This increases the compacting and/or the volume reduction of the laundry items in the drum 11.

FIGS. 1 and 2 show the drum 11 in its loaded position with the axis of rotation 10 perpendicular or substantially perpendicular. The superimposed openings 17 and 21 of the drum 11 and the housing 12 are located in a congruent manner one on top of the other in parallel horizontal planes. As a result, the laundry items of the respective partial batch can be loaded into the drum 11 from the laundry bag 33 located thereabove in partial batches, due to gravity. In this loading position, the drum 11 is also optionally driven in rotation about the perpendicular axis of rotation 10 at a rotational speed which results in 2 to 6 times, preferably 3 to 6 times, the gravitational acceleration (g) acting on the laundry items in the drum 11.

FIGS. 3 and 4 illustrate a preferred embodiment of the method according to the invention in which the drum 11 is pivoted about its horizontal pivot axis 23 between the loading of the drum 11 with successive partial batches in the loading position shown in FIGS. 1 and 2, namely the respective partial loading phase. This pivoting is preferably implemented at 30° to 50°, in particular 45°. In this oblique position, together with the laundry of one or more partial batches already located therein, the drum 11 is driven in a compacting phase at a greater rotational speed than in the partial loading phase, in which the individual partial batches are respectively gradually loaded into the drum 11 which is located in the loading position. This rotational speed is selected such that 20 times to 70 times the gravitational acceleration, i.e. 30 g to 70 g, acts on the laundry items already located in the drum 11. As a result, the laundry items in the drum 11 are compacted to a greater extent and their volume significantly reduced thereby. Primarily, or in particular for this reason, when the drum 11 is driven in rotation about its oblique axis of rotation 10 at a higher rotational speed, whereby 5 g to 70 g, preferably 30 g to 70 g, act on the laundry items, this results in the formation of a ring of laundry in the drum 11, by the laundry uniformly bearing in an annular manner against the entire inner circumference of the lateral surface 14 of the drum 11 due to centrifugal force. If already one or more partial batches have been previously loaded into the drum 11 and a ring of laundry has been already formed in the compacting phase, the laundry batch loaded last into the drum 11 bears as a further ring of laundry internally against the ring of laundry already present in the drum 11 and/or preferably is combined therewith. Moreover, space and/or a sufficiently large free space for the next laundry batch is provided in the central region, in particular in a central and/or internal region, of the drum 11.

It is particularly advantageous if liquid is supplied to the laundry items in the drum 11 before and/or in the compacting phase shown in FIGS. 3 and 4 of the respective partial batch. This can be fresh water with or without washing additives, but also washing water reused from previous washing processes or liquid separated from the laundry during spinning, in particular washing liquor.

The aforementioned supply of liquid to the laundry items in the immersion position shown in FIGS. 3 and 4 with the drum 11 positioned obliquely, leads to the laundry items being softer and heavier and thereby better compacted, in particular more reliably, to form a complete ring of laundry on the preferably cylindrical lateral surface 14 of the drum 11. Since the drum 11 is driven in rotation more rapidly in the immersion position, with at the same time the supply of liquid with the drum positioned obliquely, this represents a compacting phase.

The supply of liquid to the drum 11 and/or the laundry items of one or more or optionally all of the partial batches located therein, is carried out by a plurality of liquid jets 27 which are generated by liquid outlet openings 26 of the annular pipe 24 which surrounds the opening 21 of the front wall 20 of the housing 12. Due to a uniform distribution of the liquid outlet openings 26, which optionally can be nozzle-like, a funnel-shaped or umbrella-like path of all of the liquid jets 27 is produced on the inner circumferential surface 25 of the annular pipe 24.

In the device shown in the figures, the liquid outlet openings 26 in the circumferential surface 25 of the annular pipe 24 are oriented such that all of the liquid jets 27 generated by the liquid outlet openings 26 converge into the interior of the drum 11. Preferably, due to the oblique position of the drum 11 in its immersion position and in the compacting phase, all of the liquid jets 27 converge such that they are brought together just short of the lowest point of the drum 11 which is positioned obliquely, or are located closely adjacent to one another. This lowest point preferably starts from a point at which the lateral surface 14 and the bottom wall 15 meet at the bottom in the drum 11 (FIG. 3).

If, after the partial batch which was loaded last into the drum 11 has been immersed in the compacting phase shown in FIGS. 3 and 4, at least one further partial batch has to be loaded into the drum 11 after completing the compacting phase, i.e. after forming a ring of laundry consisting of the laundry items loaded last into the drum 11, preferably together with the immersion liquid, the drum 11 is pivoted back into the loading position, shown in FIGS. 1 and 2, with an approximately perpendicular axis of rotation 10. Then the next partial loading phase is carried out with a further partial batch or the last partial batch. Then the drum 11 is pivoted back into the immersion position shown in FIGS. 3 and 4 for performing the compacting phase.

After the last partial batch has been loaded, when the entire laundry batch has been loaded into the drum 11, it is conceivable to bypass the immersion position with the compacting phase and to pivot the drum about the pivot axis 23 immediately from the loading position with a perpendicular axis of rotation 10 into the washing position shown in FIGS. 5 and 6, with an approximately horizontal axis of rotation 10.

Optionally, in washer-extractors the spinning of the laundry items following the washing also takes place in the washing position.

The unloading of wet-treated, i.e. washed or washed and spun, laundry items of the respective laundry batch is also carried out in the washing position or the washing and spinning position shown in FIGS. 5 and 6. To this end, it is possible to re-open the cover 22 of the housing 12 which is closed before pivoting the fully loaded drum 11 into the horizontal position shown in FIGS. 5 and 6.

LIST OF REFERENCE SIGNS

10 Axis of rotation
11 Drum
12 Housing
13 Drive
14 Lateral surface
15 Bottom wall
16 Front wall
17 Opening
18 Lateral surface
19 Bottom wall
20 Front wall
21 Opening
22 Lid
23 Pivot axis
24 Annular pipe
25 Circumferential surface
26 Liquid outlet opening
27 Liquid jet
28 Gap
29 Protective ring
30 Ring
31 Edge
32 Circular surface
33 Laundry bag

The invention claimed is:

1. A method for the wet treatment, of laundry batches consisting of a plurality of laundry items, wherein the laundry items of the respective laundry batch are loaded into a drum which can be driven in rotation, the laundry batch is washed when the drum is driven in rotation, optionally spun thereafter, and after washing and/or spinning unloaded from the drum, wherein the loading of the drum with the respective laundry batch is carried out gradually in partial batches in a stepwise manner, wherein the drum is driven in rotation during the loading with the respective partial batch and/or between the loading with successive partial batches, and wherein when loading the drum with one respective partial batch and/or after loading the drum with the respective partial batch, liquid is supplied to the laundry items in the drum and/or when they enter the drum and the drum is driven at a higher rotational speed such that forces act in the manner of a spinning process on the laundry items in the drum.

2. The method as claimed in claim 1, wherein the loading of the drum with the respective partial batch is carried out when the axis of rotation of the drum is upright, and the opening of the drum is located at the top and/or when the drum is driven in rotation.

3. The method as claimed in claim 1, wherein after loading with one respective partial batch the drum is driven in rotation in the manner of a spinning process and/or at higher rotational speed, than during the loading.

4. The method as claimed in claim 1, wherein after loading the drum with one respective partial batch, the drum is pivoted from its loading position, into a position in which the axis of rotation runs obliquely to the perpendicular, and in this obliquely oriented position the drum is driven in the manner of the spinning process.

5. The method as claimed in claim 1, wherein at least when the drum is driven in rotation, the behavior and/or the position of the laundry items in the drum are monitored between successive loadings of the drum with partial batches.

* * * * *